US006198236B1

(12) United States Patent
O'Neill

(10) Patent No.: US 6,198,236 B1
(45) Date of Patent: Mar. 6, 2001

(54) METHODS AND APPARATUS FOR CONTROLLING THE INTENSITY OF A FLUORESCENT LAMP

(75) Inventor: Dennis P. O'Neill, Monte Sereno, CA (US)

(73) Assignee: Linear Technology Corporation, Milpitas, CA (US)

( * ) Notice: Subject to any disclaimer, the term of this patent is extended or adjusted under 35 U.S.C. 154(b) by 0 days.

(21) Appl. No.: 09/359,854

(22) Filed: Jul. 23, 1999

(51) Int. Cl.[7] ..... G05F 1/00
(52) U.S. Cl. ..... 315/307; 315/194
(58) Field of Search ..... 315/307, 97, 194, 315/291, DIG. 4, 199, 225, 226; 363/16, 60

(56) References Cited

U.S. PATENT DOCUMENTS

| | | | | |
|---|---|---|---|---|
| 4,769,753 | * | 9/1988 | Knudson et al. | 363/60 |
| 5,220,250 | * | 6/1993 | Szuba | 315/307 |
| 5,367,223 | * | 11/1994 | Eccher | 315/97 |
| 5,408,162 | | 4/1995 | Williams | 315/224 |
| 5,548,189 | | 8/1996 | Williams | 315/224 |
| 5,872,429 | * | 2/1999 | Xia et al. | 315/194 |
| 5,923,129 | * | 7/1999 | Henry | 315/307 |
| 5,930,121 | * | 7/1999 | Henry | 363/16 |

OTHER PUBLICATIONS

Jim Williams "Measurement and Control Circuit Collection", *Linear Applications Handbook*, vol. II, Jun. 1991, pp. AN45–1 through AN45–24.

Jim Williams "Illumination Circuitry for Liquid Crystal Displays", *Linear Applications Handbook*, vol. II, Aug. 1992, pp. AN49–1 through AN49–13.

Jim Williams "Techniques for 92% Efficient LCD Illumination", *Linear Applications Handbook*, vol. III, Aug. 1993, pp. AN55–1 through AN55–44.

* cited by examiner

*Primary Examiner*—Don Wong
*Assistant Examiner*—Chuc Tran
(74) *Attorney, Agent, or Firm*—Michael E. Shanahan; Fish & Neave

(57) ABSTRACT

This invention provides apparatus and methods for causing a fluorescent lamp drive circuit to provide a continuous drive signal over a first (high) range of lamp intensity, and a pulse width modulated (PWM) drive signal over a second (low) range of lamp intensity, with a smooth transition between continuous and PWM drive that is unnoticeable to the user. This invention also provides fluorescent lamp circuits that include lamp intensity control circuitry, fluorescent lamp drive circuitry and a fluorescent lamp, the lamp intensity control circuitry providing control signals that cause the fluorescent lamp drive circuit to provide a continuous drive signal over a first (high) range of lamp intensity, and a PWM drive signal over a second (low) range of lamp intensity, with a smooth transition between continuous and PWM drive that is unnoticeable to the user.

33 Claims, 7 Drawing Sheets

METHODS AND APPARATUS FOR CONTROLLING THE INTENSITY OF A FLUORESCENT LAMP

BACKGROUND OF THE INVENTION

This invention relates to methods and apparatus for controlling the intensity of a fluorescent lamp. More particularly, this invention relates to methods and apparatus for providing control signals for a fluorescent lamp drive circuit to control the intensity of a fluorescent lamp. This invention also relates to fluorescent lamp circuits that include lamp intensity control circuitry, fluorescent lamp drive circuitry and a fluorescent lamp.

Fluorescent lamps increasingly are being used to provide efficient and broad-area visible light. For example, fluorescent lamps are used to back-light or side-light liquid crystal displays used in portable computer displays and flat panel liquid crystal displays. Fluorescent lamps also have been used to illuminate automobile dashboards and may be used with battery-driven, emergency-exit lighting systems.

Fluorescent lamps are useful in these and other low-voltage applications because they are more efficient, and emit light over a broader area, than incandescent lamps. Particularly in applications requiring long battery life, such as portable computers, the increased efficiency of fluorescent lamps translates into extended battery life, reduced battery weight, or both.

Liquid crystal computer displays typically are illuminated using a fluorescent lamp, such as a cold cathode fluorescent lamp (CCFL) that requires a high voltage, low current power source, and requires a much higher voltage to start than it does to maintain illumination. To insure a long lifetime, the lamp must not be operated above a maximum or below a minimum current. If a CCFL is operated at high current, the lamp becomes stressed and the lamp lifetime reduces. If a CCFL is operated at low current, the gaseous components inside the lamp will not fully ionize, and the lamp will slowly poison itself. In addition, at low currents, the lamp illumination tends to become uneven. Indeed, at low currents, the lamp may experience a so-called "thermometer effect," in which one end of the lamp is dark.

Previously known fluorescent lamp drive circuits typically provide a continuous drive signal to illuminate a CCFL. To vary the intensity of a CCFL, the magnitude of the continuous drive current may be varied. Thus, to adjust the brightness of a liquid crystal computer display that includes a CCFL, the magnitude of the continuous drive current may be reduced to dim the display, or increased to brighten the display. Because of the lamp's narrow operating current range, however, a display that uses a CCFL has a narrow dimming range.

One previously known alternative to this continuous technique uses pulse width modulation (PWM) to extend the dimming range of a fluorescent lamp. That is, rather than varying the magnitude of a continuous drive signal to the lamp, the drive circuitry provides a drive signal that switches the lamp ON and OFF from maximum current to zero current at a fixed frequency. To control the lamp intensity, the drive circuit varies the duty cycle of the drive signal. Thus, a 100% duty cycle provides maximum bulb brightness, whereas a lower duty cycle effectively dims the lamp. PWM techniques extend the dimming range of the lamp without problems associated with uneven illumination at the low end of the dimming range.

To prevent noticeable flicker or interaction with ambient lighting, the PWM frequency must be approximately 100 to 200 Hz. A problem with this PWM technique is that except when the drive circuit operates the lamp at maximum brightness, the drive circuit always switches the lamp ON at maximum current and OFF at zero current at a 100 to 200 Hz rate. Constantly switching the lamp from OFF to ON requires that the drive circuitry repeatedly supply the high voltage necessary to start the lamp, which stresses the lamp and drive circuitry, and limits lamp lifetime.

In view of the foregoing, it would therefore be desirable to provide methods and apparatus for controlling the intensity of a fluorescent lamp without reducing the lamp's lifetime.

It further would be desirable to provide methods and apparatus that combine the advantages of the continuous and PWM techniques for controlling lamp intensity.

SUMMARY OF THE INVENTION

It is an object of this invention to provide methods and apparatus for controlling the intensity of a fluorescent lamp without reducing the lamp's lifetime.

It further is an object of this invention to provide methods and apparatus that combine the advantages of the continuous and PWM techniques for controlling lamp intensity.

These and other objects are accomplished in accordance with the principles of the present invention by providing control signals for a fluorescent lamp drive circuit. The control signals may be used to cause a fluorescent lamp drive circuit to provide a continuous drive signal over a first (high) range of lamp intensity, and a PWM drive signal over a second (low) range of lamp intensity, with a smooth transition between continuous and PWM drive that is unnoticeable to the user.

In addition, this invention provides fluorescent lamp circuits that include lamp intensity control circuitry, fluorescent lamp drive circuitry, a fluorescent lamp and current feedback circuitry, the lamp intensity control circuitry and current feedback circuitry providing control signals that cause the fluorescent lamp drive circuit to provide a continuous drive signal over a first (high) range of lamp intensity, and a PWM drive signal over a second (low) range of lamp intensity, with a smooth transition between continuous and PWM drive that is unnoticeable to the user.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

This detailed description is organized as follows. First, an illustrative embodiment of a lamp intensity control circuit is described that provides control signals in accordance with this invention. Second, a fluorescent lamp circuit is described that includes a lamp intensity control circuit, fluorescent lamp drive circuit, fluorescent lamp and current feedback circuit in accordance with this invention.

Figure 1:
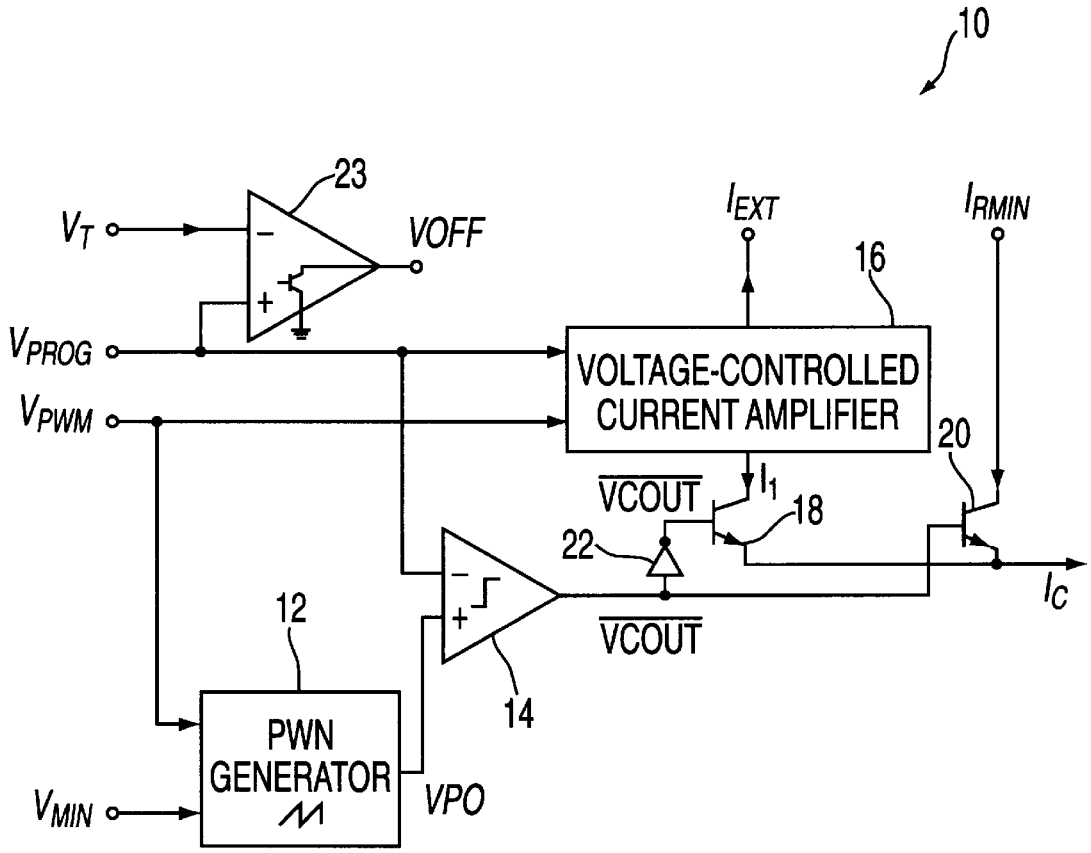
FIG. 1 is a block diagram of an exemplary lamp intensity control circuit that provides control signals in accordance with principles of the present invention.

FIG. 1 illustrates an embodiment of a lamp intensity control circuit for providing control signals of this invention. Control circuit 10 includes PWM generator 12, comparator 14, voltage-controlled current amplifier 16, switches 18 and 20, and inverter 22. As described in more detail below, control circuit 10 also may include comparator 23. Control circuit 10 receives input signals $V_{PROG}$, $V_{PWM}$, $V_{MIN}$, $I_{EXT}$ and $I_{RMIN}$, and provides control signal $I_C$ whose value is a function of $V_{PROG}$. Control circuit 10 also may receive input signal $V_T$ and may provide control signal VOFF whose value also is a function of $V_{PROG}$. $V_{PROG}$, $V_{PWM}$, $I_{EXT}$, $I_{RMIN}$ and $V_T$ are direct current (DC) signals. As described in more detail below, as a user adjusts the magnitude of $V_{PROG}$, $I_C$ varies to control the intensity of a fluorescent lamp.

Figure 2:
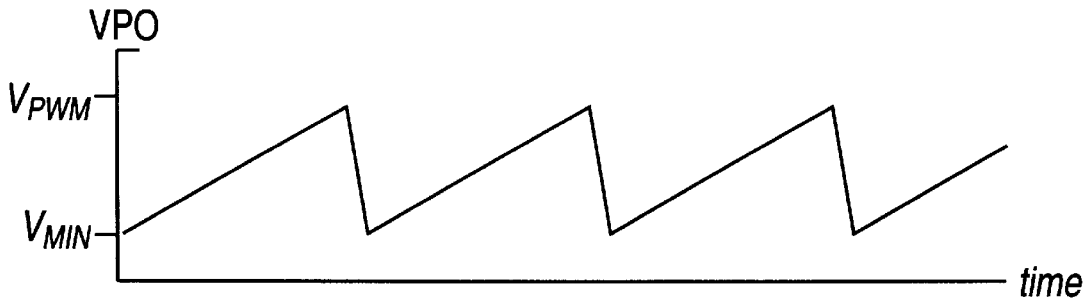
FIG. 2 is a schematic diagram of a sawtooth waveform provided by the circuit of FIG. 1.

PWM generator 12 has a first terminal coupled to $V_{PWM}$ and a second terminal coupled to $V_{MIN}$. As shown in FIG. 2, PWM generator 12 provides sawtooth output VPO that varies between $V_{MIN}$ and $V_{PWM}$. Alternatively, VPO may have a triangular waveform that varies between $V_{MIN}$ and $V_{PWM}$. VPO operates at a frequency $f_{saw}$ that is sufficiently high that a controlled lamp has little noticeable flicker, but sufficiently low to permit a lamp drive circuit to settle when the drive circuit operates in PWM mode. Frequency $f_{saw}$ preferably is between 100 to 200 Hz.

Referring again to FIG. 1, comparator 14 has a non-inverting input coupled to VPO, an inverting input coupled to $V_{PROG}$, and an output VCOUT. Inverter 22 has an input coupled to VCOUT and provides output $\overline{\text{VCOUT}}$, which equals the complement of VCOUT. If $V_{PROG}$ is greater than VPO, VCOUT is LOW and $\overline{\text{VCOUT}}$ is HIGH. If $V_{PROG}$ is less than VPO, VCOUT is HIGH and $\overline{\text{VCOUT}}$ is LOW. VCOUT is coupled to switch 20, and $\overline{\text{VCOUT}}$ is coupled to switch 18.

Figure 3:
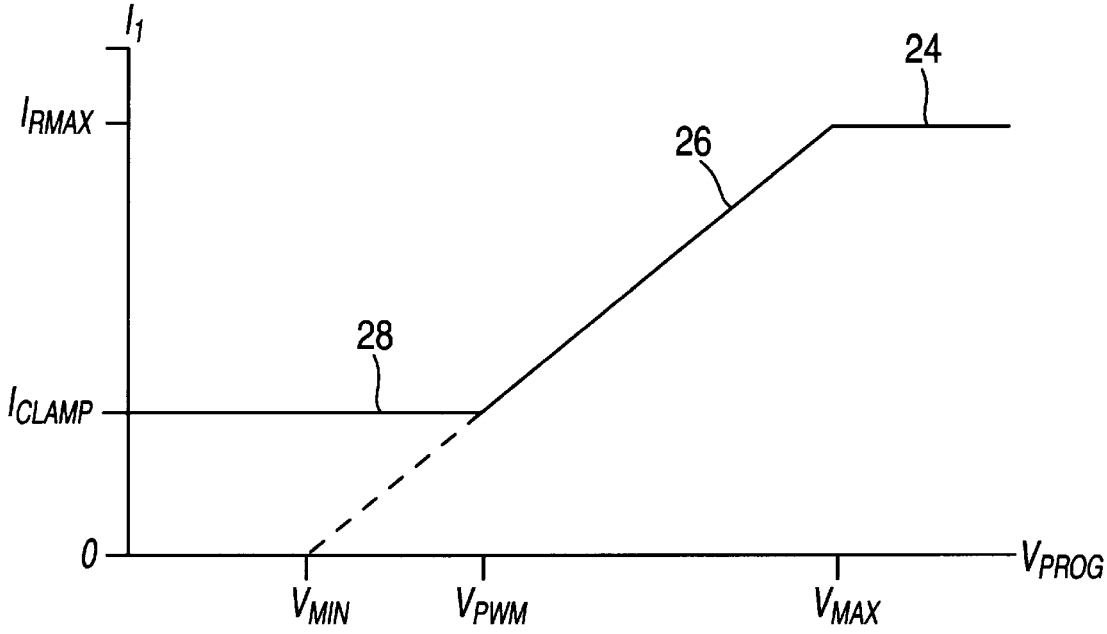
FIG. 3 is a current versus voltage transfer characteristic of the voltage-controlled current amplifier of FIG. 1.

Voltage-controlled current amplifier 16 has input terminals coupled to $I_{EXT}$, $V_{PROG}$ and $V_{PWM}$, and provides output current $I_1$ that varies as a function of $V_{PROG}$, as shown in FIG. 3. In particular, if $V_{PROG}$ is greater than or equal to $V_{MAX}$, $I_1$ equals $I_{RMAX}$ (region 24 in FIG. 3). If $V_{PROG}$ is less than $V_{MAX}$ and greater than or equal to $V_{PWM}$, $I_1$ varies linearly with $V_{PROG}$ between a maximum value of $I_{RMAX}$ and a clamp value $I_{CLAMP}$ (region 26 in FIG. 3). In this region of operation, $I_1$ equals:

$$I_1 = \left(\frac{I_{RMAX}}{V_{\text{MAX}} - V_{\text{MIN}}}\right) \times (V_{PROG} - V_{\text{MIN}}) \tag{1}$$

When $V_{PROG}=V_{PWM}$, $I_1=I_{CLAMP}$. From equation (1), $I_{CLAMP}$ equals:

$$I_{CLAMP} = \left(\frac{I_{RMAX}}{V_{\text{MAX}} - V_{\text{MIN}}}\right) \times (V_{PWM} - V_{\text{MIN}}) \tag{2}$$

Finally, if $V_{PROG}$ is less than $V_{PWM}$, $I_1$ equals $I_{CLAMP}$ (region 28 in FIG. 3).

Referring again to FIG. 1, signals VCOUT and $\overline{\text{VCOUT}}$, control switches 20 and 18 to switch currents $I_1$ and $I_{RMIN}$ to provide control signal $I_C$. Each of switches 18 and 20 may be any commonly used switch, such as a bipolar junction transistor (BJT), complementary metal oxide semiconductor (CMOS) transistor, or other suitable switch. As shown in FIG. 1, switch 18 is a BJT having a collector coupled to $I_1$, a base coupled to $\overline{\text{VCOUT}}$, and an emitter coupled to $I_C$. Switch 20 is a BJT having a collector coupled to $I_{RMIN}$, a base coupled to VCOUT, and an emitter coupled to $I_C$.

Control circuit 10 operates as follows. $I_{RMAX}$ and $I_{RMIN}$ set the maximum and minimum lamp current values, respectively, and $V_{MIN}$ sets a lower limit for brightness adjustment. $V_{PWM}$ may be selected in the range $V_{MIN} \leqq V_{PWM} \leqq V_{MAX}$ to set clamp level $I_{CLAMP}$ as shown in equation (2), above.

Figure 4:
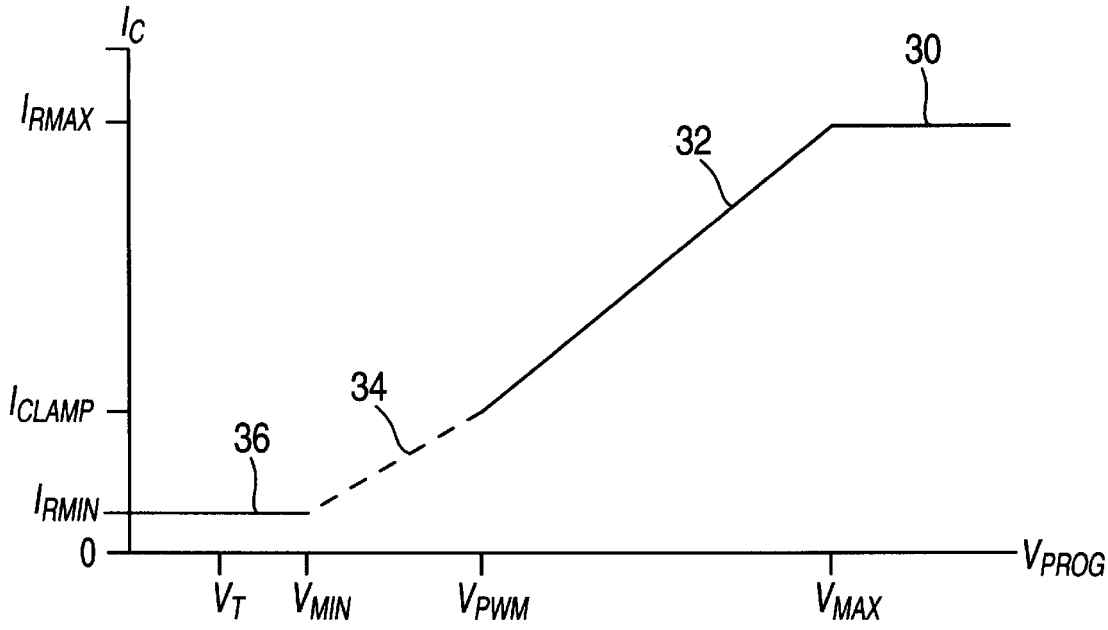
FIG. 4 is a current versus voltage transfer characteristic of the circuit of FIG. 1.

As shown in FIG. 4, as a user adjusts the magnitude of $V_{PROG}$, $I_C$ varies to set a desired lamp intensity. If $V_{PROG}$ is greater than or equal to $V_{MAX}$, $V_{PROG}$ is greater than $V_{PWM}$ and VPO, $I_1$ equals $I_{RMAX}$, VCOUT is LOW, $\overline{\text{VCOUT}}$ is HIGH, transistor 18 is ON, transistor 20 is OFF, and $I_C$ equals the emitter current of transistor 18, which substantially equals $I_{RMAX}$ (region 30 in FIG. 4).

If $V_{PROG}$ is less than $V_{MAX}$ but greater than or equal to $V_{PWM}$, $V_{MAX}$ is greater than VPO, $I_1$ has a value that varies linearly with $V_{PROG}$ between a maximum value of $I_{RMAX}$ and a minimum value $I_{CLAMP}$, VCOUT is LOW, $\overline{\text{VCOUT}}$ is HIGH, transistor 18 is ON, transistor 20 is OFF, and $I_C$ equals the emitter current of transistor 18, which substantially equals $I_1$ (region 32 in FIG. 4). In this region of operation, control current $I_C$ equals:

$$I_C = \left(\frac{I_{RMAX}}{V_{\text{MAX}} - V_{\text{MIN}}}\right) \times (V_{PROG} - V_{\text{MIN}}) \tag{3}$$

If $V_{PROG}=V_{PWM}$, $I_C=I_{CLAMP}$.

If $V_{PROG}$ is less or equal to $V_{PWM}$ but greater than or equal to $V_{MIN}$, VCOUT and $\overline{\text{VCOUT}}$ are complementary PWM signals having a clock frequency of $f_{saw}$ (and a period $T_{saw}=1/f_{saw}$), transistors 20 and 18 switch ON and OFF as controlled by VCOUT and $\overline{\text{VCOUT}}$, and $I_C$ is a PWM signal that switches between a maximum value of $I_{CLAMP}$ and a minimum value of $I_{RMIN}$, and has an average value shown as dashed region 34 in FIG. 4. That is, $I_C$ is a PWM signal that varies from 100% ON at $V_{PROG}=V_{PWM}$, to 100% OFF at $V_{PROG}=V_{MIN}$, and has an average value $I_C$ shown by the dashed line in region 34. Average value $I_C$ equals:

$$\overline{I_C} = \left(\frac{I_{CLAMP} - I_{RMIN}}{V_{PWM} - V_{\text{MIN}}}\right) \times (V_{PROG} - V_{\text{MIN}}) + I_{RMIN} \tag{4}$$

If $V_{PROG}=V_{PWM}$, $(V_{PROG}-V_{MIN})$ equals $(V_{PWM}-V_{MIN})$, and $I_C=I_{CLAMP}$. Thus, as $V_{PROG}$ is reduced from just above $V_{PWM}$ to just below $V_{PWM}$, $I_C$ smoothly transitions from region 32 to region 34 in FIG. 4.

Figure 5A:
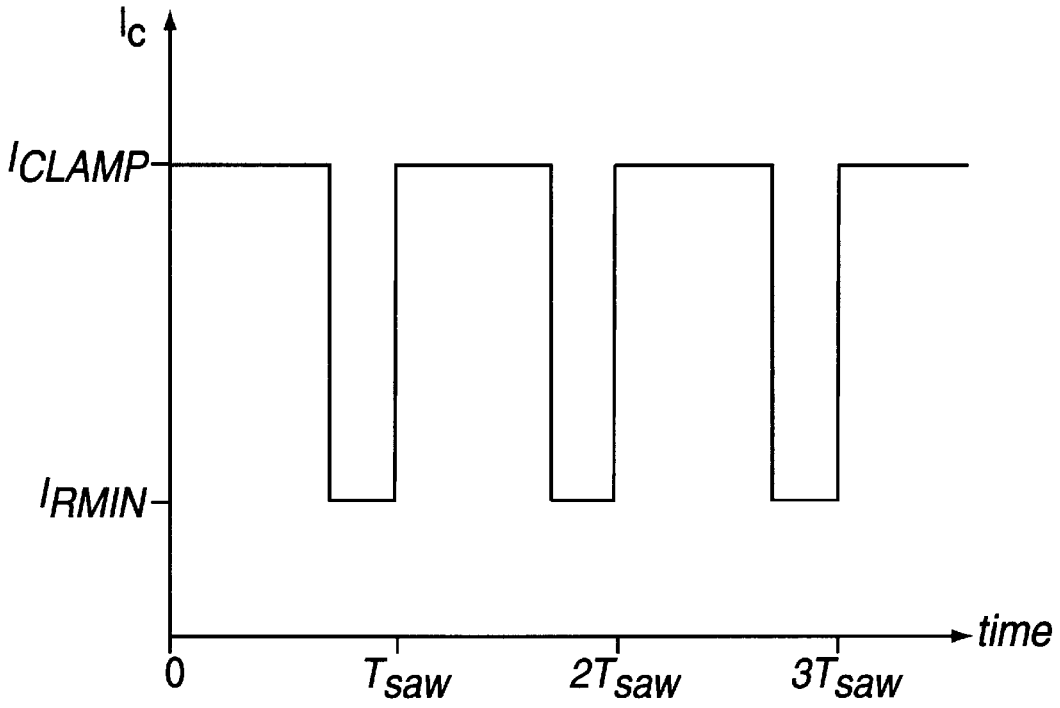
FIGS. 5A and 5B are pulse width modulated currents of the circuit of FIG. 1.
Figure 5B:
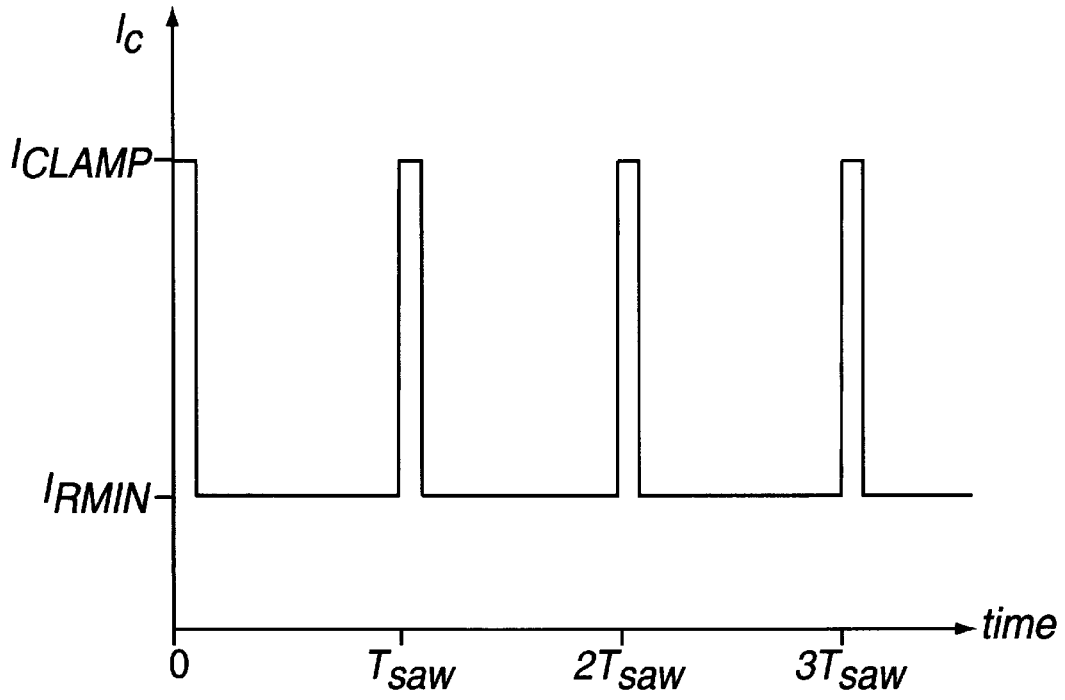

FIG. 5 illustrates $I_C$ versus time for several values of $V_{PROG}$ for $V_{MIN} \leqq V_{PROG} < V_{PWM}$. As shown in FIG. 5A, if $V_{PROG}=V_{MIN}+(0.7)\times(V_{PWM}-V_{MIN})$, from equation (4), $\overline{I_C}=(0.7)\times I_{CLAMP}+(0.3)\times I_{RMIN}$. As shown in FIG. 5B, if $V_{PROG}=V_{MIN}+(0.1)\times(V_{PWM}-V_{MIN})$, from equation (4), $I_C=(0.1)\times I_{CLAMP}+(0.9)\times I_{RMIN}$.

In PWM mode (region 34 in FIG. 4), control current $I_C$ may be used to modulate the current of a fluorescent lamp between a maximum value of $I_{CLAMP}$ and a minimum value of $I_{RMIN}$. Because the lamp is not switched from fully OFF to fully ON, the lamp intensity may be controlled without overstressing the lamp.

Referring again to FIG. 1, if $V_{PROG}$ is less than $V_{MIN}$, VCOUT is HIGH, $\overline{VCOUT}$ is LOW, transistor 18 is OFF, transistor 20 is ON, and $I_C$ equals the emitter current of transistor 20, which substantially equals $I_{RMIN}$ (region 36 in FIG. 4).

Control circuit 10 also may include circuitry to provide a control signal that may be used to reduce lamp current to zero whenever $V_{PROG}$ is below a predetermined value. For example, control circuit 10 may include comparator 23, which has an inverting input coupled to $V_T$, a non-inverting input coupled to $V_{PROG}$, and an open-collector output VOFF. $V_T$ is a threshold voltage chosen to set a value at which the lamp current should be reduced to zero, and typically is less than $V_{MIN}$. If $V_{PROG}$ is greater than $V_T$, the output of the comparator is an open circuit. If $V_{PROG}$ is less than $V_T$, the output of the comparator is LOW. Alternatively, comparator 23 may be a conventional comparator having inputs coupled to $V_{PROG}$ and $V_T$ and providing an output signal that may be used to cause fluorescent lamp drive circuitry to shut OFF current to the fluorescent lamp whenever $V_{PROG}$ is reduced below $V_T$.

Figure 6:
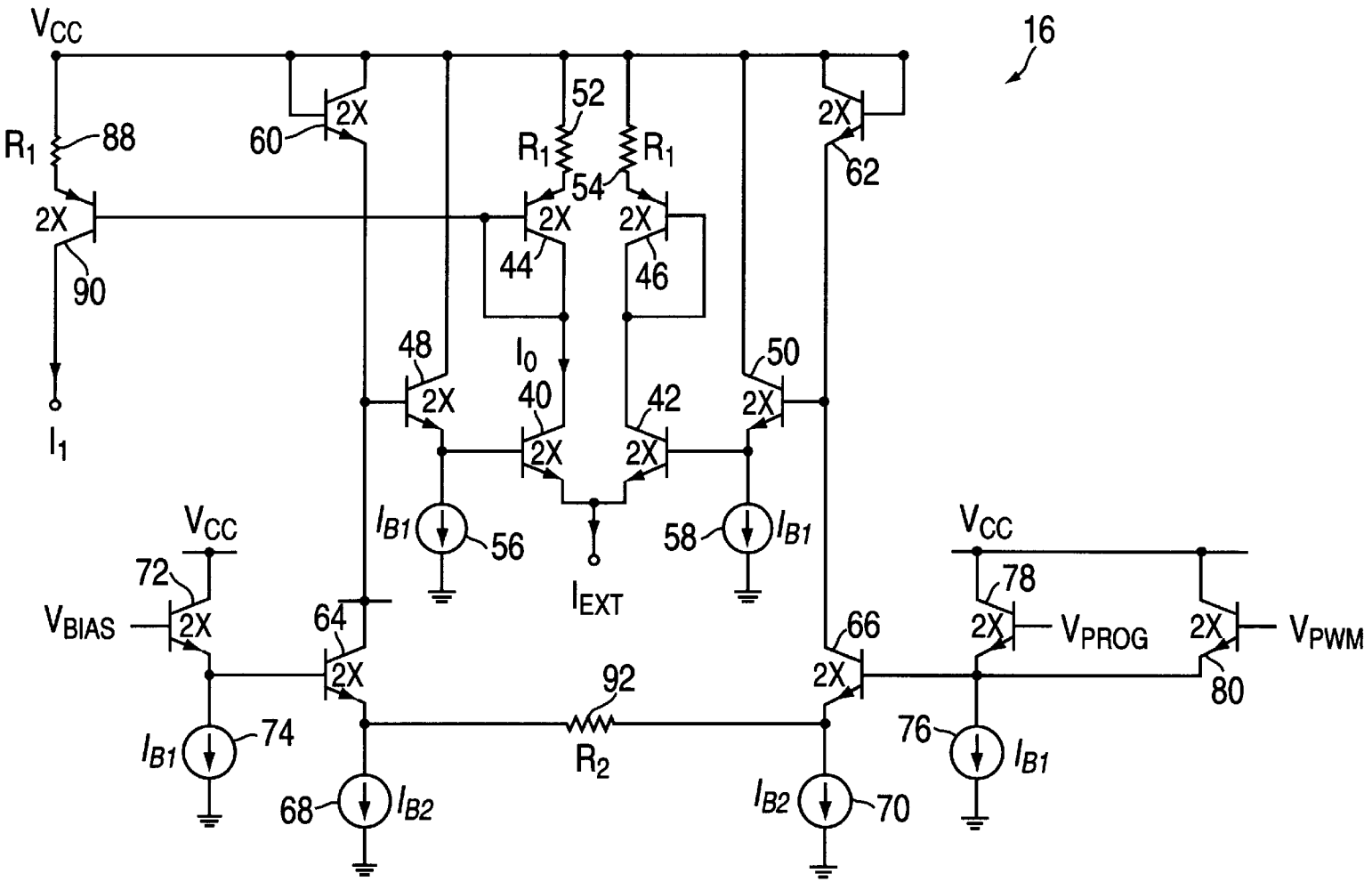
FIG. 6 is a circuit diagram of an exemplary embodiment of a voltage-controlled current amplifier of the circuit of FIG. 1.

Referring to FIG. 6, an illustrative embodiment of voltage-controlled current amplifier 16 is described. Amplifier 16 includes first and second differential gain stages and a current-mirror output stage comprised of NPN transistors 40, 42, 48, 50, 60, 62, 64, 66, 72, 78 and 80, PNP transistors 44 and 46, resistors 52, 54, 88 and 92, and current sources 56, 58, 68, 70, 74 and 76.

The first differential amplifier includes transistors 40, 42, 44, 46, 48 and 50, resistors 52 and 54, and current sources 56 and 58. The first differential amplifier has a first input at a base of transistor 48, a second input at a base of transistor 50, external current source $I_{EXT}$ coupled to emitters of transistors 40 and 42, and an output at a base of transistor 44. In this exemplary embodiment, $I_{EXT}$ conducts current $I_{RMAX}$. Diode-connected transistors 44 and 46 and emitter degeneration resistors 52 and 54 serve as loads. Current sources 56 and 58 each conduct current $I_{B1}$ whose value is chosen to keep emitter-follower transistors 48 and 50 biased ON.

The second differential amplifier includes transistors 60, 62, 64, 66, 72, 78 and 80, resistor 92, and current sources 68, 70, 74 and 76. The second differential amplifier has a first input $V_{BIAS}$ coupled to a base of transistor 72, a second input $V_{PROG}$ coupled to a base of transistor 78, a third input $V_{PWM}$ coupled to a base of transistor 80, a first output at a collector of transistor 64 coupled to the first input of the first differential amplifier, and a second output at a collector of transistor 66 coupled to the second input of the first differential amplifier.

The output stage includes transistor 90 and resistor 88, and has an input at a base of transistor 90 coupled to the output of the first differential amplifier, and an output at terminal $I_1$. Transistor 90 and transistor 44 form a current mirror, and emitter degeneration resistors 52, 54 and 88 each have a value $R_1$ chosen to reduce the effect of any base-emitter voltage ($V_{BE}$) mismatch between transistors 44, 46 and 90.

Resistor 92 has a value $R_2$, current sources 74 and 76 conduct current $I_{B1}$, and current sources 68 and 70 conduct current $I_{B2}$. $V_{BIAS}$ is a voltage source having a value of approximately $(V_{MAX}-V_{MIN})/2$ (FIG. 4). Resistance $R_2$ and bias current $I_{B2}$ have values selected so that the second differential amplifier has a linear range of operation that extends from approximately $V_{MIN}$ to $V_{MAX}$ (FIG. 4).

Amplifier 16 operates as follows. $V_{MAX}$ has a value approximately equal to $(V_{BIAS}+R_2\times I_{B2})$. If $V_{PROG}$ is greater than $V_{MAX}$, transistors 64 and 80 are OFF, transistors 78 and 66 are ON, transistor 42 is OFF, transistors 40 and 48 are ON, and transistors 40 and 44 conduct current 10 substantially equal to current $I_{EXT}=I_{RMAX}$. Transistors 44 and 90 have substantially the same base-emitter area, and resistors 52 and 88 have substantially the same resistance $R_1$. The base-emitter voltage of transistor 44 substantially equals the base-emitter voltage of transistor 90, and therefore, $I_1$ substantially equals $I_{RMAX}$. This corresponds to region 24 in FIG. 3.

As $V_{PROG}$ is reduced below $V_{MAX}$, the voltages at the emitters of transistors 66 and 78 reduce, transistor 80 remains OFF, transistor 64 begins to conduct, and the second differential amplifier enters its linear range of operation. As a result, transistor 42 begins to conduct, and steers a portion of $I_{EXT}$ away from transistors 40 and 44. As a result, $I_0$ and $I_1$ reduce linearly with $V_{PROG}$. This corresponds to region 26 in FIG. 3.

As $V_{PROG}$ is further reduced, the voltage at the base of transistor 78 approaches $V_{PWM}$, and transistors 78 and 80 both conduct current. $I_0$ and $I_1$ continue to reduce with reductions in $V_{PROG}$, until $V_{PROG}$ is slightly less than $V_{PWM}$. At that point, transistor 78 is OFF, and any further reductions in $V_{PROG}$ produce no further reductions in $I_0$ or $I_1$. $V_{PWM}$ thus sets clamp level $I_{CLAMP}$ for amplifier 16. This corresponds to region 28 in FIG. 3.

Figure 7:
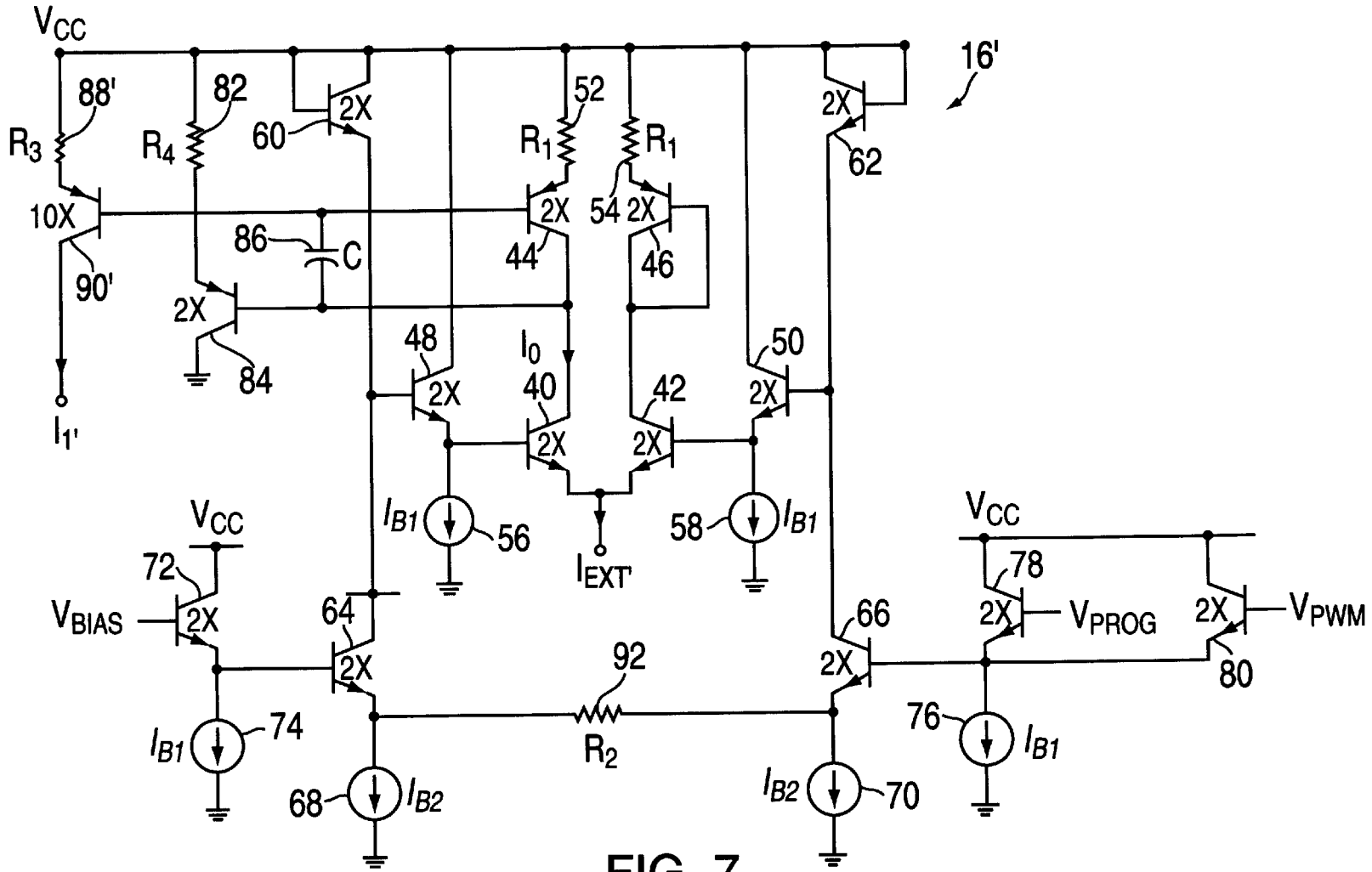
FIG. 7 is circuit diagram of an alternative exemplary embodiment of a voltage-controlled current amplifier of the circuit of FIG. 1.

In this embodiment, resistor 88 and transistor 90 are rationed to resistor 52 and transistor 44 so that $I_1=I_0$. By modifying the ratios, $I_1$ may be made substantially equal to a multiple of FIG. 7 shows an alternative embodiment of a voltage-controlled current amplifier in accordance with this invention that consumes less power than amplifier 16, and provides a more accurate output current at maximum current levels. In particular, amplifier 16' is similar to amplifier 16, but resistor 88' and transistor 90' are rationed so that $I_1=5\times I_0$. That is, transistor 90' has a base-emitter junction area five times the size of the base-emitter junction area of transistors 44 and 46, and resistor 881 has a resistance $R_3$ that is one-fifth the size of resistance $R_1$ (i.e., $R_3=R_1/5$). Further, to provide a maximum current $I_1=I_{RMAX}$, $I_{EXT}=I_{RMAX}/5$. Thus, the differential pair comprising transistors 40, 42, 44 and 46, and resistors 52 and 54 operate at a lower current than in amplifier 16.

Because transistor 40 operates at a lower current than in amplifier 16, the collector current of transistor 40 may not by itself be sufficient to drive the base of transistor 90'. Thus, an amplifier including resistor 82, transistor 84 and capacitor 86 is included to supply additional base drive for transistor 90'. Resistor 82 biases transistor 84 at a small current, and has a resistance $R_4$ that is much larger than $R_1$ and $R_3$ (e.g., $R_4=25\times R_1$). Capacitor 84 has a capacitance C to compensate the base-drive amplifier.

Figure 8:
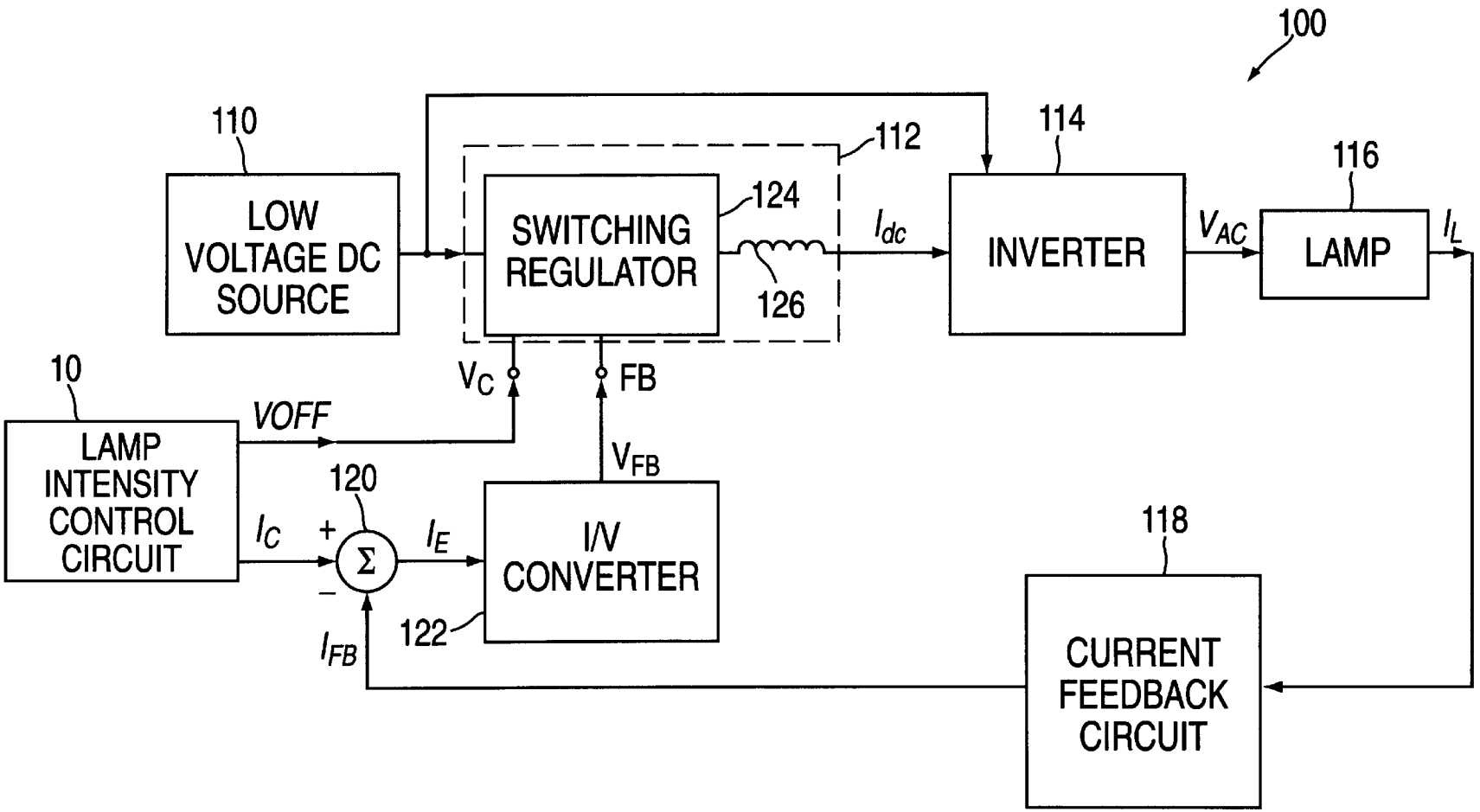
FIG. 8 is a block diagram of a lamp circuit that includes the lamp intensity control circuit of FIG. 1.

FIG. 8 illustrates an exemplary embodiment of a fluorescent lamp circuit that includes a lamp intensity control circuit in accordance with this invention. Circuit 100 includes control circuit 10, low voltage DC source 110, regulator 112, high voltage inverter 114, lamp 116, current feedback circuit 118, summing node 120, and current-to-voltage converter 122.

Low-voltage DC source 110 provides power for circuit 100, and may be any source of DC power. For example, in the case of a portable computer such as a lap-top or notebook computer, DC source 110 may be one or more nickel-cadmium or nickel-hydride batteries providing 3–20 volts. Alternatively, if lamp circuit 100 is used with an automobile dashboard, DC source 110 may be a 12–14 volt automobile battery and power supply.

DC source 110 supplies low-voltage DC to regulator 112 and may provide low-voltage DC to inverter 114. Regulator 112 may include any of a number of commercially available linear or switching regulators. As shown in FIG. 8, voltage regulator 112 includes switching regulator 124 and inductor 126. Switching regulator 124 may be, for example, the LT-1072 switching regulator manufactured by Linear Technology Corporation, Milpitas, Calif., or other suitable switching regulator. When implemented using the LT-1072, switching regulator 124 includes feedback terminal FB adapted to receive a feedback signal by which the output of voltage regulator 112 can be controlled, and control terminal $V_C$, by which the switching regulator may be placed in shutdown mode.

Voltage regulator 112 provides regulated low-voltage DC output $I_{dc}$ to inverter 114. Inverter 114 converts $I_{dc}$ to a high-voltage, high-frequency AC output $V_{AC}$ of sufficient magnitude to drive fluorescent lamp 116. Fluorescent lamp 116 may be any type of fluorescent lamp. For example, in the case of lighting a display in a portable computer, fluorescent lamp 116 may be a cold- or hot-cathode fluorescent lamp.

Current feedback circuit 118 generates a feedback current $I_{FB}$ that is proportional to fluorescent lamp current $I_L$. Summing node 120 provides an error signal $I_E$ proportional to the difference between control current $I_C$ and feedback current $I_{FB}$. Current-to-voltage converter 122 converts error signal $I_E$ to voltage $V_{FB}$, which is coupled to terminal FB of switching regulator 124. This feedback loop causes the magnitude of lamp current $I_L$ to be proportional to the control current $I_C$, so that $I_E$ is substantially zero.

Figure 9:
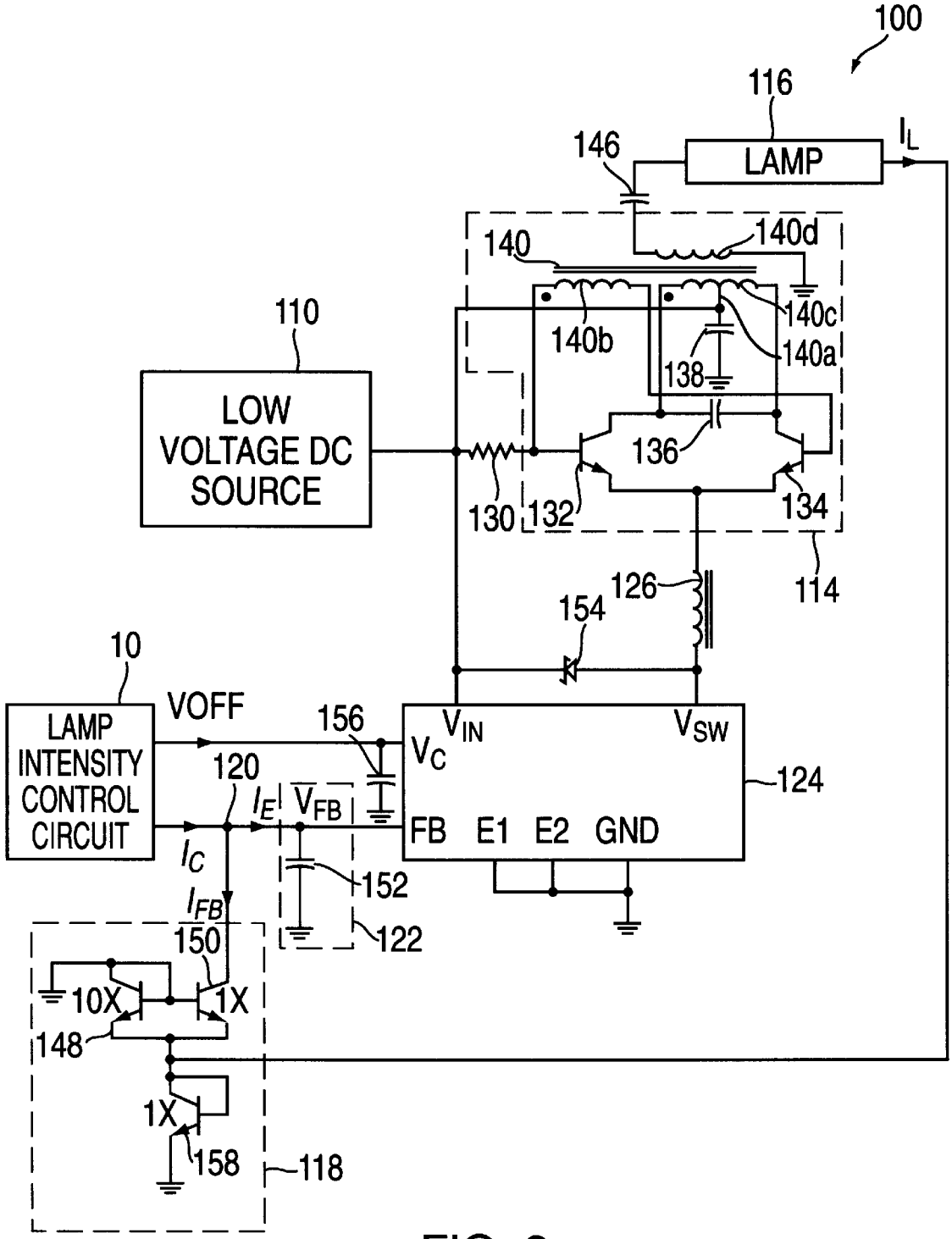
FIG. 9 is a schematic diagram of an exemplary embodiment of the lamp circuit of FIG. 8.

FIG. 9 shows a schematic diagram of an exemplary embodiment of lamp circuit 100 of FIG. 8. Switching regulator 124 is implemented using an LT-1072 switching regulator, although any other suitable switching regulator may be used. As shown in FIG. 9, switching regulator 124 includes pin $V_{IN}$ coupled to low voltage DC source 110, terminals E1, E2 and GND coupled to GROUND, control terminal $V_C$ coupled to open-collector output VOFF from lamp intensity control circuit 10 and coupled through capacitor 156 to GROUND, switched output pin $V_{SW}$ coupled to inductor 126 and Schottky diode 154, and feedback pin FB coupled to terminal $I_C$ of lamp intensity control circuit 10 and capacitor 152.

Inverter circuit 114 is a current-driven, high-voltage, push-pull inverter which converts DC power from low voltage DC source 110 to high-voltage, sinusoidal AC. Inverter circuit 114 is a self-oscillating circuit, and includes transistors 132 and 134, capacitors 136 and 138, and transformer 140. Transistors 132 and 134 conduct out of phase and switch each time transformer 140 saturates. During a complete cycle, the magnetic flux density in the core of transformer 140 varies between a saturation value in one direction and a saturation value in the opposite direction. During the cycle time when the magnetic flux density varies from negative minimum to positive maximum, one of transistors 132 and 134 is ON. During the rest of the cycle time (i.e., when the magnetic flux density varies from positive maximum to negative minimum), the other transistor is ON.

Switching of transistors 132 and 134 is initiated when the magnetic flux density in transformer 140 begins to saturate. At that time, the inductance of transformer 140 decreases rapidly toward zero, with the result that a quickly rising high collector current flows in the transistor that is ON. This current spike is picked up by transformer bias winding **140*b* of transformer 140. Because the base terminals of transistors 132 and 134 are coupled to bias winding 140*b* of transformer 140, the current spike is fed back into the base of the transistor that produced the spike. As a result, that transistor drops out of saturation and into cutoff, and the transistor is turned OFF. Accordingly, the current in transformer 140** abruptly drops, and the transformer winding voltages then reverse polarity resulting in the turning ON of the other transistor that previously had been OFF. The switching operation is then repeated for this second transistor.

Transistors 132 and 134 alternately switch ON and OFF at a duty cycle of approximately 50 percent. Capacitor 136, coupled between the collectors of transistors 132 and 134, causes what would otherwise be square-wave-like voltage oscillation at the collectors of transistors 132 and 134 to be substantially sinusoidal. Capacitor 136, therefore, operates to reduce radio-frequency (RF) emissions from the circuit. The characteristics of transformer 140, capacitor 136, fluorescent lamp 116, and ballast capacitor 146 coupled to secondary winding **140*d* of transformer 140 primarily determine the frequency of oscillation. Capacitor 138 reduces the high frequency impedance so that transformer center tap 140*a*** sees zero impedance at all frequencies.

Transformer 140 steps-up the sinusoidal voltage at the collectors of transistors 132 and 134 to produce at secondary winding **140*d* an AC waveform of sufficiently high voltage to drive fluorescent lamp 116 (shown coupled to secondary winding 140*d* through ballast capacitor 146). Ballast capacitor 146 inserts a controlled impedance in series with lamp 116 to minimize sensitivity of the circuit to lamp characteristics and to minimize exposure of fluorescent lamp 116** to DC components.

Inverter 114 and current-mode switching regulator circuit 124 thus operate to deliver a controlled AC current at high voltage to fluorescent lamp 116. Inductor 126, coupled between $V_{SW}$ of regulator 124 and the emitters of transistors 132 and 134, is an energy storage element for switching regulator circuit 124. Inductor 126 also sets the magnitude of the collector currents of transistors 132 and 134 and, hence, the energy through primary winding **140*c* of transformer 140 that is delivered to lamp 116 via secondary winding 140*d*. Schottky diode 154, coupled between low voltage DC power source 110 and switched output pin $V_{SW}$, maintains current flow through inductor 126 during the OFF cycles of switching regulator circuit 124. Resistor 130 DC-biases the respective bases of transistors 132 and 134**.

Inverter 114 may be implemented using circuitry other than that illustrated in FIG. 9, For example, inverter 114 may be implemented using ceramic step-up transformer technologies.

Current feedback circuit 118 may be implemented in integrated circuit technology, and includes diode-connected transistor 148, transistor 150 and diode-connected transistor 158. Transistor 148 has its base and collector coupled to GROUND, and has its emitter coupled to lamp 116. Transistor 150 has its collector coupled to summing node 120, its base coupled to the base of transistor 148, and its emitter coupled to lamp 116 and the emitter of transistor 148. Transistor 158 has its base and collector coupled together and to lamp 116, and its emitter coupled to GROUND.

Diode-connected transistor 148 and diode-connected transistor 158 half-wave rectify lamp current $I_L$. Transistor 158 shunts positive portions of each cycle of $I_L$ to GROUND, and transistor 148 shunts a fraction of negative portions of $I_L$ to GROUND. In particular, transistor 148 and 150 form a current mirror, with the collector of transistor 150 conducting a fraction of the current conducted by the collector of transistor 148. As shown in FIG. 9, the base-emitter area of transistor 148 is ten times the size of the base-emitter area of transistor 150, and therefore the collector current of transistor 150 is approximately one-tenth the collector current of transistor 148. As a result, feedback current $I_{FB}$ equals the negative portions of $I_L$, reduced in magnitude by approximately one-eleventh.

Error current $I_E$ equals the difference between control current $I_C$ and feedback current $I_{FB}$. Current-to-voltage converter 122 comprises capacitor 152, which provides voltage $V_{FB}$ equal to the integral of error current $I_E$. $V_{FB}$ therefore is proportional to error current $I_E$, and is coupled to feedback pin FB of switching regulator 125. The above connections close the feedback control loop that regulates lamp current $I_L$ to control the intensity of lamp 116.

Upon start-up of circuit 100 of FIG. 9, voltage $V_{FB}$ on feedback pin FB generally is below the internal reference voltage of regulator circuit 124 (i.e., 1.23 volts for the LT-1072 discussed above). Thus, full duty cycle modulation at the switched output pin $V_{sw}$ of regulator circuit 124 occurs. As a result, transistors 132 and 134 and inductor 126 conduct current from center tap 140*a* of transformer 140. This current is conducted in switched fashion to GROUND by the action of switching regulator 124. This switching action controls lamp current $I_L$, which is set by the magnitude of the feedback signal $V_{FB}$ at the feedback terminal FB of switching regulator 124. The feedback loop forces switching regulator 124 to modulate the output of inverter 114 to whatever value is required so that error current $I_E$ is substantially zero.

The circuit of FIG. 9 may be implemented using commercially available components. For example, the circuit can be constructed and operated using the components and values set forth below:

| Component | Source or Value |
|---|---|
| Regulator 124 | LT-1072 |
| Inductor 126 | 300 μH (COILTRONICS CTX300-4) |
| Resistor 130 | 1 KΩ |
| Transistors 132 & 134 | MPS650 |
| Capacitor 136 | low loss 0.02 microfarad (Metalized polycarb WIMA-FKP2 (Germany) preferred) |
| Capacitor 138 | 10 μF |
| Transformer 140 | SUMIDA-6345-020 (available from SUMIDA ELECTRIC (USA) CO., LTD., of Arlington Heights, Illinois) or COILTRONICS CTX110092-1 (available from Coiltronics Incorporated, of Pompano Beach, Florida) |
| Capacitor 146 | 33 pF, rated up to 3 KV |
| Transistor 148 | 10X |
| Transistor 150 | 1X |
| Schottky diode 154 | 1N5818 |
| Capacitor 156 | 0.1 μF |
| Transistor 158 | 1X |

The above circuit components and values are merely illustrative. Other circuit components and values also may be used.

Persons of ordinary skill in the art will recognize that lamp intensity control circuits of this invention may be implemented using integrated circuit technology along with other circuitry. For example, a lamp intensity control circuit may be combined along with a regulator circuit, such as a current-mode switching regulator circuit, and a current feedback circuit on a single integrated circuit to provide a fluorescent lamp controller.

In addition, persons of ordinary skill in the art will recognize that lamp intensity control circuits and lamp circuits of the present invention can be implemented using circuit configurations other than those shown and discussed above. All such modifications are within the scope of the present invention, which is limited only by the claims that follow.

I claim:

1. A method for controlling the intensity of a fluorescent lamp based on a magnitude of a first control signal, the lamp coupled to a fluorescent lamp drive circuit and conducting a lamp current, the method comprising:

providing a lamp current control signal to the drive circuit that comprises a direct current (DC) signal if the magnitude of the first control signal is greater than a first predetermined threshold, and that comprises a pulse-width modulated (PWM) signal if the magnitude of the first control signal is less than the first predetermined threshold;

varying a magnitude of the DC signal, when provided, to obtain a desired lamp intensity; and adjusting a duty cycle of the PWM signal, when provided, to obtain a desired lamp intensity.

2. The method of claim 1, wherein the DC signal has a magnitude that varies based on the magnitude of the first control signal.

3. The method of claim 1, wherein the duty cycle of the PWM signal varies based on the magnitude of the first control signal.

4. The method of claim 1, wherein the first predetermined threshold is adjustable.

5. The method of claim 1, wherein the DC signal has a magnitude that varies linearly with the magnitude of the first control signal.

6. The method of claim 1, wherein the duty cycle of the PWM signal varies linearly with the magnitude of the first control signal.

7. The method of claim 1, wherein the lamp current control signal comprises a first substantially constant value if the magnitude of the first control signal is greater than a second predetermined threshold.

8. The method of claim 7, wherein the first substantially constant value comprises a maximum desired lamp current.

9. The method of claim 1, wherein the lamp current control signal comprises a second substantially constant value if the magnitude of the first control signal is less than a third predetermined threshold.

10. The method of claim 9, wherein the second substantially constant value comprises a minimum desired lamp current.

11. A method for controlling the intensity of a fluorescent lamp based on a magnitude of a first control signal, the lamp conducting a current, the method comprising:

providing a fluorescent lamp drive circuit coupled to the fluorescent lamp, the drive circuit comprising a control terminal for controlling the lamp current;

providing a lamp current control signal that comprises a direct current (DC) signal if the magnitude of the first control signal is greater than a first predetermined threshold, and that comprises a pulse-width modulated (PWM) signal if the magnitude of the first control signal is less than the first predetermined threshold;

varying a magnitude of the DC signal, when provided, to obtain a desired lamp intensity; and adjusting a duty cycle of the PWM signal, when provided, to obtain a desired lamp intensity;

providing a feedback signal proportional to the lamp current;

providing an error signal proportional to a sum of the lamp current control signal and the feedback signal; and coupling the error signal to the control terminal.

12. The method of claim 11, wherein the DC signal has a magnitude that varies based on the magnitude of the first control signal.

13. The method of claim 11, wherein the duty cycle of the PWM signal varies based on the magnitude of the first control signal.

14. The method of claim 11, wherein the first predetermined threshold is adjustable.

15. The method of claim 11, wherein the DC signal has a magnitude that varies linearly with the magnitude of the first control signal.

16. The method of claim 11, wherein the duty cycle of the PWM signal varies linearly with the magnitude of the first control signal.

17. The method of claim 11, wherein the lamp current control signal comprises a first substantially constant value if the magnitude of the first control signal is greater than a second predetermined threshold.

18. The method of claim 17, wherein the first substantially constant value comprises a maximum desired lamp current.

19. The method of claim 11, wherein the lamp current control signal comprises a second substantially constant value if the magnitude of the first control signal is less than a third predetermined threshold.

20. The method of claim 19, wherein the second substantially constant value comprises a minimum desired lamp current.

21. A fluorescent lamp intensity control circuit that receives a control signal at a control signal terminal, a first predetermined threshold at a first input terminal, a second predetermined threshold at a second input terminal, a first current at a first current terminal, a second current at a second current terminal, and that generates an intensity control signal at an intensity control signal terminal, the control circuit comprising:

a voltage-controlled current amplifier comprising a first terminal coupled to the control signal terminal, a second terminal coupled to the first input terminal, a third terminal coupled to the first current terminal, and an output terminal, the current amplifier generating a direct current (DC) output signal at the output terminal, wherein the DC output signal has a magnitude that (a) has a first substantially constant value that is proportional to the first current if a magnitude of the first control signal is greater than a third predetermined threshold, (b) varies linearly with the magnitude of the first control signal if the magnitude of the first control signal is less than the third predetermined threshold and greater than the first predetermined threshold, and (c) has a second substantially constant value if the magnitude of the first control signal is less than the first predetermined threshold;

a pulse width modulator comprising a first modulator input terminal coupled to the first input terminal and a second modulator input terminal coupled to the second input terminal, and providing a sawtooth signal at an output terminal, the sawtooth signal having a peak amplitude substantially equal to the first predetermined threshold and a minimum amplitude substantially equal to the second predetermined threshold;

a first comparator comprising an inverting input coupled to the control signal terminal, a non-inverting input coupled to the output terminal of the pulse width modulator, and an output terminal;

an inverter having an input terminal coupled to the output terminal of the comparator, and an output terminal;

a first switch comprising a first terminal coupled to the output terminal of the voltage controlled current amplifier, a second terminal coupled to the output terminal of the inverter, and a third terminal coupled to the intensity control signal terminal; and a second switch comprising a first terminal coupled to the second current terminal, a second terminal coupled to the output terminal of the comparator, and a third terminal coupled to the intensity control signal terminal.

22. The intensity control circuit of claim 21, further receiving a fourth predetermined threshold signal at a third input terminal, and further comprising a second comparator comprising input terminals coupled to the third input terminal and the control signal terminal, and providing an output at an output terminal.

23. A fluorescent lamp circuit for use with a direct current (DC) power source and a fluorescent lamp, the lamp conducting a lamp current, the circuit comprising:

a regulator circuit comprising an input terminal coupled to the DC power source, a feedback terminal, and an output terminal;

an inverter circuit comprising an input terminal coupled to the output of the regulator, and an output terminal coupled to the lamp;

a current feedback circuit comprising an input terminal coupled to the lamp, and an output terminal;

a lamp intensity control circuit that provides a lamp current control signal at a control signal terminal, the lamp current control signal comprising a direct current (DC) signal if the magnitude of the first control signal is greater than a first predetermined threshold, and comprising a pulse-width modulated (PWM) signal if the magnitude of the first control signal is less than the first predetermined threshold;

a current-to-voltage converter comprising an input terminal coupled to the control signal terminal and to the output terminal of the current feedback circuit, and an output terminal coupled to the feedback terminal of the regulator.

24. A method for controlling the intensity of a fluorescent lamp based on a magnitude of a first control signal, the lamp coupled to a fluorescent lamp drive circuit and conducting a lamp current, the method comprising:

providing a lamp current control signal to the drive circuit that comprises a direct current (DC) signal if the magnitude of the first control signal is greater than a first predetermined threshold, and that comprises a pulse-width modulated (PWM) signal if the magnitude of the first control signal is less than the first predetermined threshold; and varying a magnitude of the pulse-modulated signal, when provided, between a non-zero minimum value and a maximum value.

25. The method of claim 24, wherein the DC signal has a magnitude that varies based on the magnitude of the first control signal.

26. The method of claim 24, wherein the PWM signal comprises pulses having a duty cycle that varies based on the magnitude of the first control signal.

27. The method of claim 24, wherein the first predetermined threshold is adjustable.

28. The method of claim 24, wherein the DC signal has a magnitude that varies linearly with the magnitude of the first control signal.

29. The method of claim 24, wherein the PWM signal comprises pulses having a duty cycle that varies linearly with the magnitude of the first control signal.

30. The method of claim 24, wherein the lamp current control signal comprises a first substantially constant value if the magnitude of the first control signal is greater than a second predetermined threshold.

31. The method of claim 30, wherein the first substantially constant value comprises a maximum desired lamp current.

32. The method of claim 24, wherein the lamp current control signal comprises a second substantially constant value if the magnitude of the first control signal is less than a third predetermined threshold.

33. The method of claim 32, wherein the second substantially constant value comprises a minimum desired lamp current.

* * * * *

UNITED STATES PATENT AND TRADEMARK OFFICE

CERTIFICATE OF CORRECTION

PATENT NO. : 6,198,236 B1
DATED : March 6, 2001
INVENTOR(S) : Dennis P. O'Neill

It is certified that error appears in the above-identified patent and that said Letters Patent is hereby corrected as shown below:

Column 4,
Line 44, change "less or" to -- less than or --.

Column 6,
Line 37, after "a multiple of" add -- I*rmax* --.
Line 46, change "881" to -- 88' --.

Column 8,
Line 27, delete "zero" and replace with -- a low --.

Signed and Sealed this

Twenty-eighth Day of May, 2002

*Attest:*

*Attesting Officer*

JAMES E. ROGAN
*Director of the United States Patent and Trademark Office*